US010796502B2

(12) United States Patent
Rockwell et al.

(10) Patent No.: US 10,796,502 B2
(45) Date of Patent: Oct. 6, 2020

(54) MANAGED VEHICLE DATA DELIVERY

(71) Applicant: FORD GLOBAL TECHNOLOGIES, LLC, Dearborn, MI (US)

(72) Inventors: Mark Anthony Rockwell, Royal Oak, MI (US); Benjamin M. Rocci, Ann Arbor, MI (US); Changjoon Im, Northville, MI (US); Christian Krozal, South Lyon, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 155 days.

(21) Appl. No.: 16/132,989

(22) Filed: Sep. 17, 2018

(65) Prior Publication Data

US 2020/0090420 A1 Mar. 19, 2020

(51) Int. Cl.
*G07C 5/00* (2006.01)
*G07C 5/08* (2006.01)

(52) U.S. Cl.
CPC ..... *G07C 5/008* (2013.01); *G07C 5/0808* (2013.01)

(58) Field of Classification Search
CPC ..... G07C 5/008; G07C 5/0808
See application file for complete search history.

(56) References Cited

U.S. PATENT DOCUMENTS

| | | | | |
|---|---|---|---|---|
| 9,348,840 | B2 | 5/2016 | Sedayao et al. | |
| 9,460,307 | B2 | 10/2016 | Breslau et al. | |
| 2006/0220805 | A1* | 10/2006 | Thomas | B60C 23/0445 340/426.33 |
| 2016/0028824 | A1* | 1/2016 | Stenneth | H04L 67/12 709/219 |
| 2016/0104330 | A1* | 4/2016 | Rudenko | G07C 5/0808 701/29.1 |
| 2016/0247394 | A1* | 8/2016 | Stenneth | G08G 1/0112 |
| 2017/0043884 | A1* | 2/2017 | Bedin | G07C 5/008 |
| 2017/0178420 | A1* | 6/2017 | Byrd, Jr. | G07C 5/008 |
| 2018/0150776 | A1* | 5/2018 | Anagnos | G06Q 10/04 |

* cited by examiner

*Primary Examiner* — Marthe Y Marc-Coleman
(74) *Attorney, Agent, or Firm* — Michael J. Spenner; Brooks Kushman P.C.

(57) ABSTRACT

From diagnostic configurations, individual data elements and a frequency for collection of each data element including removing redundant collection of data elements are identified. Diagnostic data from the vehicle in accordance with the identification are periodically collected. The diagnostic data is sent to the server with instructions that specify each data element in the diagnostic data and for which configurations each data element in the diagnostic data is required.

16 Claims, 3 Drawing Sheets

MANAGED VEHICLE DATA DELIVERY

TECHNICAL FIELD

Aspects of the disclosure generally relate to managed vehicle data delivery for vehicle diagnostic requests.

BACKGROUND

Automobile diagnostic data, such as Diagnostic Trouble Codes (DTCs), form compact, informative messages. Diagnostic data was designed to allow vehicle controllers to indicate a system fault and/or a need for repair.

SUMMARY

In one or more illustrative examples, a system includes a processor programmed to identify, from diagnostic configurations, individual data elements and a frequency for collection of each data element including removing redundant collection of data elements, periodically collect diagnostic data from a vehicle in accordance with the identification, and send the diagnostic data to a server with instructions specifying each data element in the diagnostic data and which configurations require each data element.

In one or more illustrative examples, a method includes receiving diagnostic requirements, specifying vehicle data requirements, from requester devices; sending configurations to vehicles per the diagnostic requirements; receiving, from the vehicles, a plurality of diagnostic data messages, each including instructions that specify each data element in the respective message and which configurations require each data element in the respective message; compiling data conforming to the diagnostic requirements per the instructions; and sending the compiled data to the requester devices.

In one or more illustrative examples, a non-transitory computer-readable medium includes instructions that, when executed by a processor of a vehicle data server, cause the processor to receive diagnostic requirements from requester devices; send configurations to vehicles per the diagnostic requirements, each configuration including a unique identifier, the configurations including at least a first configuration specifying, at a first frequency, at least first and second data elements and a second configuration specifying, at a second frequency, at least the first data element and a third data element, the first frequency being a multiple of the second frequency; receive, from the vehicles, a plurality of diagnostic data messages at the first frequency, each including instructions that specify each data element in the respective message and unique identifiers identifying which configurations require each data element in the respective message; compile data conforming to the diagnostic requirements per the instructions; and store the compiled data in a database for access by the requester devices.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

As the use of customer vehicle data increases, additional requests for vehicle data are being sent to vehicles. Many of these requests contain overlap in the data being queried from controllers that are on-board the vehicle. Multiple data requests for the same data increases the amount of on-vehicle bus load (potentially leading to loss of data) and inefficiently uses cellular data allotments when delivering the data back to a cloud server.

A splice-on glue-off (SoGo) system may be implemented to perform managed vehicle data delivery. SoGo is an on-vehicle enabler that receives new data request configurations from a cloud server, splices out the individual data elements included in the data request, and provides instructions with respect to how to compile, or "glue" the data elements back together, to be offloaded to the cloud server. The cloud server then compiles the data back together per the instructions provided by the SoGo on-vehicle component. This compiled data may then be stored to a cloud database for review by the requesters.

Figure 1:
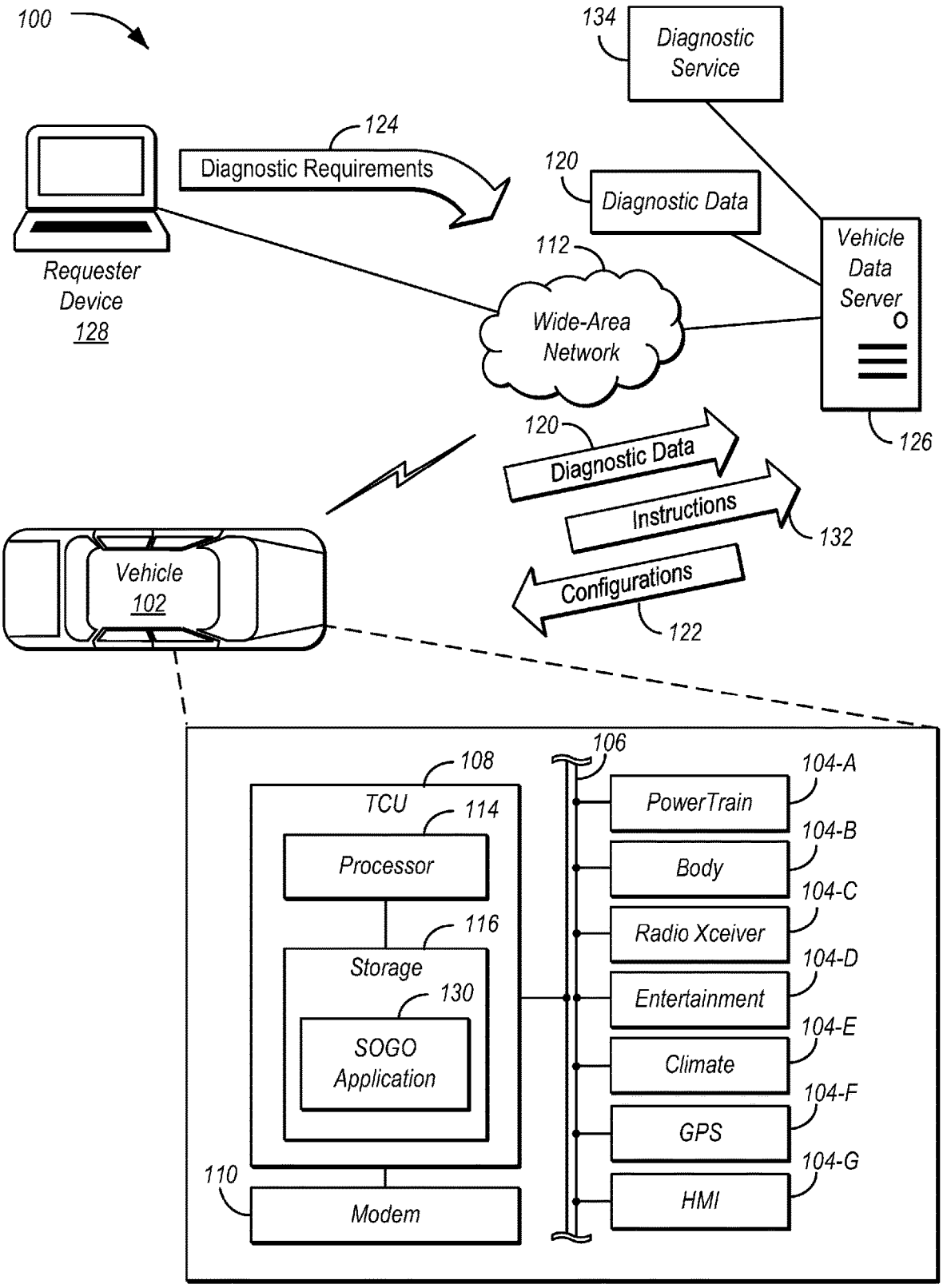
FIG. 1 illustrates an example system implementing managed vehicle data delivery.

FIG. 1 illustrates an example system 100 implementing managed vehicle data delivery. As illustrated, a vehicle 102 includes a plurality of vehicle controllers 104 in communication over one or more vehicle buses 106. The system 100 also includes a vehicle data server 126 configured to maintain diagnostic data 120 received from various vehicles 102. The vehicle 102 further includes a telematics control unit (TCU) 108 configured to send diagnostic data 120, including diagnostic information, to the vehicle data server 126. The TCU 108 may utilize a SoGo application 130 installed to the TCU 108 to process request configurations 122 that define data to be retrieved from the vehicle 102, and send diagnostic data 120 to the vehicle data server 126, and send instructions 132 to the vehicle data server 126 regarding how to glue the diagnostic data 120 back together to form the requested configurations 122 of data. The vehicle data server 126 may utilize a diagnostic service 134 to compile the received diagnostic data 120 in accordance with the instructions 132. It should be noted that the system 100 is merely an example, and other arrangements or combinations of elements may be used.

The vehicle 102 may include various types of automobile, crossover utility vehicle (CUV), sport utility vehicle (SUV), truck, recreational vehicle (RV), boat, plane or other mobile machine for transporting people or goods. In many cases, the vehicle 102 may be powered by an internal combustion engine. As another possibility, the vehicle 102 may be a hybrid electric vehicle (HEV) powered by both an internal combustion engine and one or more electric motors, such as a series hybrid electric vehicle (SHEV), a parallel hybrid electrical vehicle (PHEV), or a parallel/series hybrid electric vehicle (PSHEV). As the type and configuration of vehicle 102 may vary, the capabilities of the vehicle 102 may correspondingly vary. As some other possibilities, vehicles 102 may have different capabilities with respect to passenger capacity, towing ability and capacity, and storage volume. For title, inventory, and other purposes, vehicles 102 may be associated with unique identifiers, such as VINs.

The vehicle 102 may include a plurality of controllers 104 configured to perform and manage various vehicle 102 functions under the power of the vehicle battery and/or drivetrain. As depicted, the example vehicle controllers 104 are represented as discrete controllers 104-A through 104-G. However, the vehicle controllers 104 may share physical hardware, firmware, and/or software, such that the functionality from multiple controllers 104 may be integrated into a single controller 104, and that the functionality of various such controllers 104 may be distributed across a plurality of controllers 104.

As some non-limiting vehicle controller 104 examples: a powertrain controller 104-A may be configured to provide control of engine operating components (e.g., idle control components, fuel delivery components, emissions control components, etc.) and for monitoring status of such engine operating components (e.g., status of engine codes); a body controller 104-B may be configured to manage various power control functions such as exterior lighting, interior lighting, keyless entry, remote start, and point of access status verification (e.g., closure status of the hood, doors and/or trunk of the vehicle 102); a radio transceiver controller 104-C may be configured to communicate with key fobs, mobile devices, or other local vehicle 102 devices; an entertainment controller 104-D may be configured to support voice command and BLUETOOTH interfaces with the driver and driver carry-on devices; a climate control management controller 104-E may be configured to provide control of heating and cooling system components (e.g., compressor clutch, blower fan, temperature sensors, etc.); a global positioning system (GPS) controller 104-F may be configured to provide vehicle location information; and a human-machine interface (HMI) controller 104-G may be configured to receive user input via various buttons or other controls, as well as provide vehicle status information to a driver, such as fuel level information, engine operating temperature information, and current location of the vehicle 102.

The vehicle bus 106 may include various methods of communication available between the vehicle electronic control units (ECUs) 104, as well as between the TCU 108 and the vehicle ECUs 104. As some non-limiting examples, the vehicle bus 106 may include one or more of a vehicle controller area network (CAN), an Ethernet network, and a media-oriented system transfer (MOST) network. Further aspects of the layout and number of vehicle buses 106 are discussed in further detail below.

The TCU 108 may include network hardware configured to facilitate communication between the vehicle ECUs 104 and with other devices of the system 100. For example, the TCU 108 may include or otherwise access a cellular modem 110 configured to facilitate communication with a wide-area network 112. The wide-area network 112 may include one or more interconnected communication networks such as the Internet, a cable television distribution network, a satellite link network, a local area network, and a telephone network, as some non-limiting examples. As another example, the TCU 108 may utilize one or more of BLUETOOTH, Wi-Fi, or wired USB network connectivity to facilitate communication with the wide-area network 112 via the user's mobile device.

The TCU 108 may further include various types of computing apparatus in support of performance of the functions of the TCU 108 described herein. In an example, the TCU 108 may include one or more processors 114 configured to execute computer instructions, and a storage 116 medium on which the computer-executable instructions and/or data may be maintained. A computer-readable storage medium (also referred to as a processor-readable medium or storage 116) includes any non-transitory (e.g., tangible) medium that participates in providing data (e.g., instructions) that may be read by a computer (e.g., by the processor(s)). In general, the processor 114 receives instructions and/or data, e.g., from the storage 116, etc., to a memory and executes the instructions using the data, thereby performing one or more processes, including one or more of the processes described herein. Computer-executable instructions may be compiled or interpreted from computer programs created using a variety of programming languages and/or technologies, including, without limitation, and either alone or in combination, JAVA, C, C++, C #, FORTRAN, PASCAL, VISUAL BASIC, PYTHON, JAVA SCRIPT, PERL, PL/SQL, etc.

The TCU 108 may be configured to include one or more interfaces from which vehicle information may be sent and received. In an example, the TCU 108 may be configured to facilitate the collection of DTC data and/or other vehicle information from the vehicle controllers 104 connected to the one or more vehicle buses 106. While only a single bus 106 is illustrated, it should be noted that in many examples, multiple vehicle buses 106 are included, with a subset of the controllers 104 connected to each bus 106. Accordingly, to access a given controller 104, the TCU 108 may be configured to maintain a mapping of which buses 106 are connected to which controllers 104, and to access the corresponding bus 106 for a controller 104 when communication with that particular controller 104 is desired.

The collected information retrieved from the controllers 104 over the vehicle buses 106 may be referred to as diagnostic data 120. The TCU 108 may store the collected diagnostic data 120 to the storage 116 of the TCU 108 or, in other examples, to other storage in communication with the TCU 108. The vehicle information retrieved by the TCU 108 may include, as some non-limiting examples, accelerator pedal position, steering wheel angle, vehicle speed, vehicle location (e.g., GPS coordinates, etc.), vehicle unique identifier (e.g., VIN), engine revolutions per minute (RPM), and vehicle HMI information, such as steering wheel button press information. Thus, diagnostic data 120 may include collected DTC information and/or other vehicle information stored to the storage 116 of the TCU 108.

The configurations 122 include information defining diagnostic elements, codes, or other information to be captured from the vehicles 102. The configurations 122 may be sent to the vehicle 102, and the vehicle 102 may return the diagnostic data 120 in response. Diagnostic requirements 124 may be used to define the diagnostic codes or other information that is specified in the configurations 122. The diagnostic requirements 124 may further specify attributes of the vehicles 102 that should receive the configurations 122. In an example, these attributes may include one or more of: a make of a vehicle 102, a model of a vehicle 102, a model year of a vehicle 102, a vehicle identification number (VIN) of a vehicle 102, or a VIN range of vehicle 102.

The vehicle data server 126 and a requester device 128 may each include various types of computing apparatus, such as a computer workstation, a server, a desktop computer, a virtual server instance executed by a mainframe server, or some other computing system and/or device. Similar to the TCU 108, the vehicle data server 126 and the requester device 128 generally include a memory on which computer-executable instructions may be maintained, where the instructions may be executable by one or more processors (not shown for clarity). Such instructions and other data may be stored using a variety of computer-readable media. In an example, the vehicle data server 126 may be configured to maintain the diagnostic data 120 received from the TCU 108 of the vehicles 102 by way of the network 112.

The requester device 128 may be used to allow an operator to configure the diagnostic requirements 124 that are used by the vehicle data server 126 to send the configurations 122. In an example, a user of the requester device 128 may specify one or more diagnostic codes to be captured from a set of vehicles 102. The user may also specify what vehicles 102 are intended to receive the configurations 122 (e.g., make, model, VIN range, etc.).

The SoGo application 130 may be one application included on the storage 116 of the TCU 108. The SoGo application 130 may include instructions that, when executed by the processor 114 of the TCU 108, cause the TCU 108 to perform functions periodically and/or in response to receipt of configurations 122 from the vehicle data server 126. These functions may include to periodically collect the diagnostic data 120 information from the controllers 104 (e.g., including DTC information) based on configurations 122 received from the vehicle data server 126, store the information for transmission, and transmit the diagnostic data 120 to the vehicle data server 126 over the wide-area network 112. The SoGo application 130 may further create instructions 132 that may be used to compile the diagnostic data 120 into data that meets the specified configurations 122.

Figure 2:
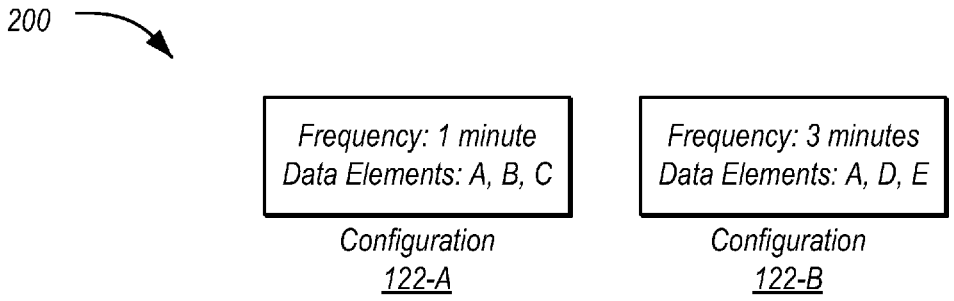
FIG. 2 illustrates an example of multiple configurations.

FIG. 2 illustrates an example 200 where the configurations 122 include two configurations, a first configuration 122-A that collects data elements A, B, and C every minute, and a second configuration 122-B that collects data elements A, D, and E every three minutes. Clearly, if the data element A is being collected every minute for the first configuration 122-A, then the data element A does not also have to be collected a second time for the second configuration 122-B. Accordingly, the SoGo application 130 may capture A, B, and C every minute, and D and E every third minute.

Referring back to FIG. 1, the instructions 132 may include information that specifies how the diagnostic data 120 may be combined to fulfil the diagnostics requested by the configurations 122.

Figure 3:
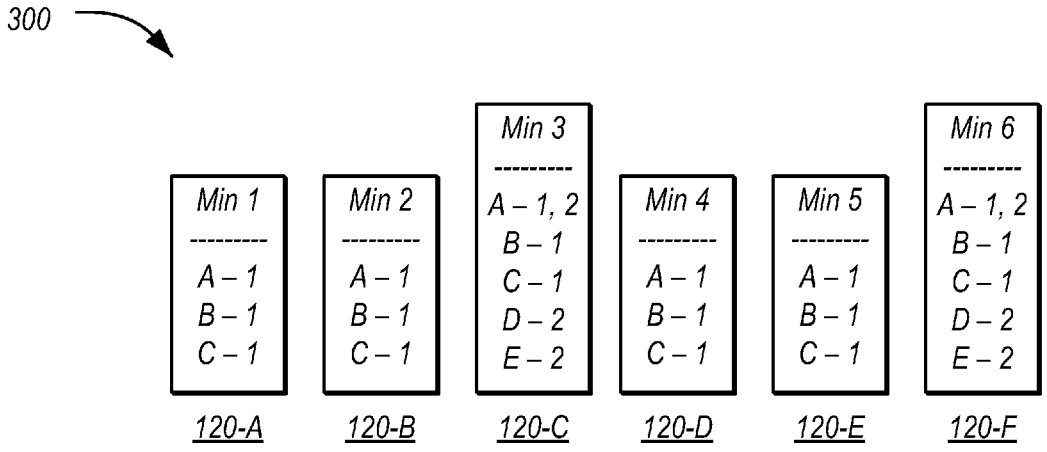
FIG. 3 illustrates an example of diagnostic data being sent from the vehicle in accordance with the configurations in the example of FIG. 2.

FIG. 3 illustrates an example 300 of diagnostic data 120 being sent from the vehicle 102 in accordance with the configurations 122 in the example 200. In this example, the SoGo application 130 may create instructions 132 that indicate that data is sent from the vehicle 102 every minute as data elements A, B, and C for the first configuration 122-A (e.g., A-1, B-1, C-1), while on every third minute data is sent from the vehicle as data element A for the first and second configuration, data elements B and C for the first configuration, and data elements D and E for the second configuration (e.g., A-12, B-1, C-1, D-2, E-2). As shown in the example 300, the instructions 132 may take the form of header information included in the diagnostic data 120 that is sent from the vehicle 102, to allow a recipient of the data to compile the received data back into the data requested for each configuration 122. For each data element, the instructions 132 accordingly may specify for which configurations 122 that data element is applicable.

It should be noted that while in these examples the configurations 122 are arbitrarily specified by the integers 1 and 2, in many examples the identifiers of the configurations 122 are specified by the diagnostic service 134 in the configurations 122. For instance, the diagnostic service 134 may assign the identifiers to the configurations 122 responsive to determining which diagnostic requirements 124 apply to which vehicles 102. For instance, if a vehicle 102 is specified as providing information according to two diagnostic requirements 124, then the diagnostic service 134 may specify a first identifier for the first configuration and a second identifier for the second configuration, and may map those identifiers back to the diagnostic requirements 124 that identified the vehicle 102 as being a target for providing data. Accordingly, the diagnostic service 134 may be able to keep track of which diagnostics data 120 corresponds to which diagnostic requirements 124, as well as how to understand the instructions 132 from the vehicle 102 regarding how to compile the diagnostic data 120.

Referring back to FIG. 1, the diagnostic service 134 may be one application included on the storage of the vehicle data server 126. The diagnostic service 134 may include instructions that, when executed by the processor of the vehicle data server 126, cause the vehicle data server 126 to receive the diagnostic data 120 information from vehicles 102, receive diagnostic requirements 124 from the requester device 128, convert the diagnostic requirements 124 into configurations 122, and provide configurations 122 to the vehicles 102. The diagnostic service 134 may further receive the diagnostic data 120 from the vehicles 102 and compile the overall results in accordance with the instructions 132 to fulfil the requirements specified by the diagnostic requirements 124. For instance, to continue the example, the diagnostic service 134 may compile the received data into a first configuration 122 of data elements A, B, and C every minute, and a second configuration 122 of data elements A, D, and E every three minutes.

The diagnostic service 134 may, accordingly, provide this information pursuant to the configurations 122 for analysis. In an example, the compiled information may be made available to the requester device 128 specifying the diagnostic requirements 124 from which the configurations 122 were generated.

Figure 4:
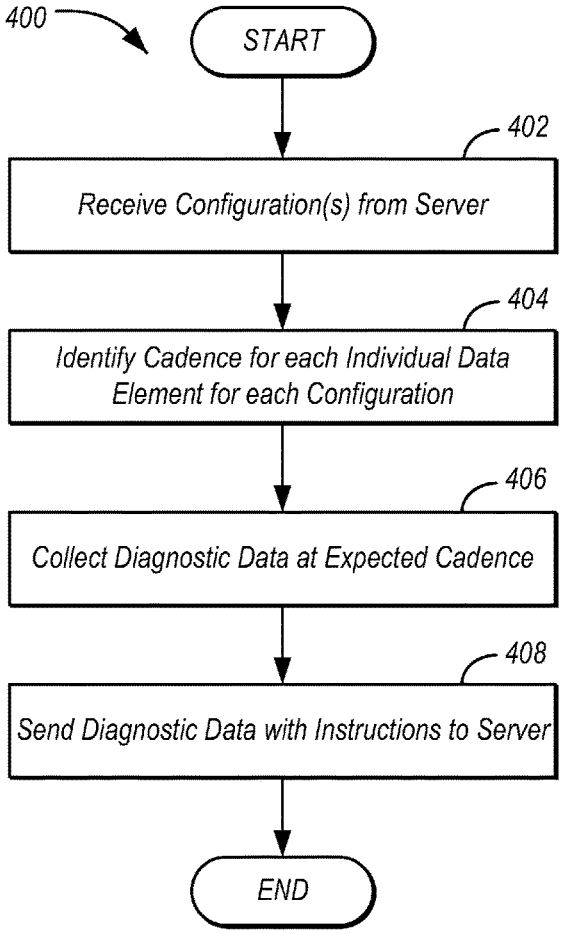
FIG. 4 illustrates an example process for collecting data by a vehicle while avoiding multiple data requests for the same data.

FIG. 4 illustrates an example process 400 for collecting data by a vehicle 102 while avoiding multiple data requests for the same data. In an example, the process 400 may be performed by the vehicle 102 executing the SoGo application 130.

At operation 402, the vehicle 102 receives configurations 122 from the vehicle data server 126. In an example, the vehicle data server 126 may send one or more configurations 122 to the vehicle 102 to cause the vehicle 102 to capture data elements at a cadence specified by the configurations 122. This information may be received by the SoGo application 130. An example of configurations 122 is shown in the example 200.

At 404, the vehicle 102 identifies a cadence for each individual data element from the configurations 122. In an example, the SoGo application 130 identifies each data element that is required in each configuration 122 as well as the frequency at which each data element is required. If a data element is required by multiple configurations 122, the SoGo application 130 identifies to collect those data elements once at a frequency to satisfy the multiple configurations 122, rather than collecting the same data element multiple times. This information may be used to generate the instructions 132 to be provided to the vehicle data server 126 with the diagnostic data 120.

At operation 406, the vehicle 102 collects diagnostic data 120 at the expected cadence for each of the configurations 122. In an example, the SoGo application 130 directs the TCU 108 to collect DTC data and/or other vehicle information from the vehicle ECUs 104 connected to the one or more vehicle buses 106, to satisfy the requested data elements from the configurations 122. In some examples, the vehicle 102 may include a plurality of vehicle buses 106, and the SoGo application 130 may determine over which vehicle bus 106 each data element is to be retrieved. As only a single data element may be retrieved over a single vehicle bus 106 at a time, the SoGo application 130 may accordingly schedule the retrievals of the data elements such that only a single element is retrieved over a single bus 106 at once, but elements from different buses 106 may be retrieved simultaneously. Yet further, the elimination of requests for redundant data elements reduces the burden on the buses 106 for the scheduling of data element retrieval.

At 408, the vehicle 102 sends the diagnostic data 120 with the instructions 132 to the vehicle data server 126. An example of the instructions 132 being sent with the diagnostic data 120 is shown in the example 300. After operation 408, the process 400 ends.

Figure 5:
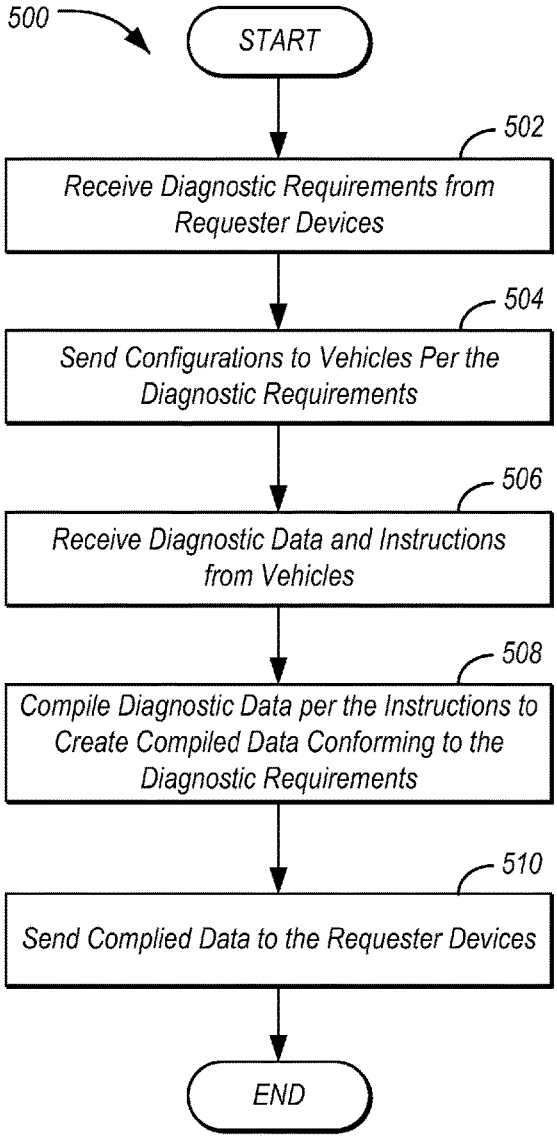
FIG. 5 illustrate an example process for compiling data from the vehicle by gluing together diagnostic data received from the vehicle as specified by the instructions.

FIG. 5 illustrate an example process 500 for compiling data from the vehicle 102 by gluing together diagnostic data 120 received from the vehicle 102 as specified by the instructions 132. In an example, the process 500 may be performed by the vehicle data server 126 executing the diagnostic service 134.

At operation 502, the vehicle data server 126 receives diagnostic requirements 124 from requester devices 128. In an example, the diagnostic requirements 124 define the diagnostic codes, elements, or other information that is to be specified in the configurations 122. The diagnostic requirements 124 may further specify attributes of the vehicles 102 that should receive the configurations 122.

At 504, the vehicle data server 126 sends the configurations 122 to one or more vehicles 102 per the diagnostic requirements 124. In an example, the vehicle data server 126 sends the configurations 122 to the vehicles 102 as specified by the diagnostic requirements 124.

At operation 506, the vehicle data server 126 receives diagnostic data 120 from the one or more vehicles 102. In an example, the vehicle data server 126 receives the diagnostic data 120 including instructions 132 that specify each data element in the diagnostic data 120 and for which of the configurations 122 each data element in the diagnostic data 120 is required. This information may be received over the wide-area network 112 as transmitted by the vehicle 102.

At 508, the vehicle data server 126 compiles the diagnostic data 120 per the instructions 132. By using the instructions 132 and the diagnostic data 120, the vehicle data server 126 can glue together the data required for each of the configurations 122. At 510, the vehicle data server 126 sends glued data to the requester devices 128. Accordingly, the requester devices 128 may access and otherwise utilize the data that was specified by the diagnostic requirements 124. After operation 510, the process 500 ends.

Thus, the disclosed systems and methods maximize the amount of data that can be collected via an over-the-air data connection, while minimizing mobile data usage. If multiple diagnostics need the same data, the data may be retrieved by the TCU 108 once across the bus and not multiple times. Additionally, as the TCU 108 may identify over which vehicle buses 106 subnet to ask for each data element, the TCU 108 may reduce vehicle buses 106 delays due to the fact that the TCU 108 can only ask for information for one data element per vehicle bus 106 at one time. Additionally, data loss caused by vehicle buses 106 overloading is eliminated.

Computing devices described herein, such as the TCU 108, vehicle data server 126, and requester device 128, generally include computer-executable instructions where the instructions may be executable by one or more computing devices such as those listed above. Computer-executable instructions, such as those of the SoGo application 130 or diagnostic service 134, may be compiled or interpreted from computer programs created using a variety of programming languages and/or technologies, including, without limitation, and either alone or in combination, JAVA™, C, C++, C #, VISUAL BASIC, JAVASCRIPT, PYTHON, JAVASCRIPT, PERL, PL/SQL, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their broadest reasonable constructions and their ordinary meanings as understood by those knowledgeable in the technologies described herein unless an explicit indication to the contrary in made herein. In particular, use of the singular articles such as "a," "the," "said," etc. should be read to recite one or more of the indicated elements unless a claim recites an explicit limitation to the contrary.

The abstract of the disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A system comprising:

a processor programmed to identify, from diagnostic configurations, individual data elements and a frequency for collection of each data element including removing redundant collection of data elements, the diagnostic configurations including a first configuration specifying, at a first frequency, at least first and second data elements and a second configuration specifying, at a second frequency, at least the first data element and a third data element, and to remove redundant collections of data elements includes to collect the first data element at a single cadence satisfying both the first frequency and the second frequency, periodically collect diagnostic data from a vehicle in accordance with the identification, and send the diagnostic data to a server with instructions specifying each data element in the diagnostic data and which configurations require each data element.

2. The system of claim 1, wherein each of the diagnostic configurations is associated with a unique identifier, and the instructions, specifying which configurations require each data element, list, for each data element, the unique identifier of each of the diagnostic configuration requiring the data element.

3. The system of claim 2, wherein the unique identifiers are specified in the diagnostic configurations.

4. The system of claim 1, wherein the processor is included in a telematics controller of a vehicle, and the telematics controller is configured to receive the diagnostic configurations from the server over a wide-area network and send the diagnostic data to the server over the wide-area network.

5. The system of claim 1, wherein the processor is further programmed to specify the instructions as a header of a message including the diagnostic data.

6. A method comprising:

receiving diagnostic requirements, specifying vehicle data requirements, from requester devices;

sending configurations to vehicles per the diagnostic requirements, the configurations including a first configuration specifying, at a first frequency, at least first and second data elements and a second configuration specifying, at a second frequency, at least the first data element and a third data element;

receiving, from the vehicles, a plurality of diagnostic data messages, each including instructions that specify each data element in the respective message and which configurations require each data element in the respective message;

compiling data conforming to the diagnostic requirements per the instructions; and sending the compiled data to the requester devices.

7. The method of claim 6, further comprising receiving the instructions as headers to the messages including the diagnostic data.

8. The method of claim 6, further comprising including in each of the configurations, a unique identifier of the respective configuration.

9. The method of claim 8, wherein the instructions specify which configurations require each data element in the diagnostic data by listing, for each data element, the unique identifier of each of the configurations for which the data element is required.

10. The method of claim 9, further comprising identifying which configurations require each data element in the respective message according to the unique identifiers in the instructions.

11. The method of claim 6, wherein the first frequency is a multiple of the second frequency, and the plurality of diagnostic data messages are received at the first frequency.

12. The method of claim 6, wherein the diagnostic data messages received at the first frequency include at least the first and second data elements, and the diagnostic data messages received at the second frequency include at least the first and third data elements.

13. The method of claim 6, further comprising storing the compiled data in a database.

14. A non-transitory computer-readable medium comprising instructions that, when executed by a processor of a vehicle data server, cause the processor to:

receive diagnostic requirements from requester devices;

send configurations to vehicles per the diagnostic requirements, each configuration including a unique identifier, the configurations including at least a first configuration specifying, at a first frequency, at least first and second data elements and a second configuration specifying, at a second frequency, at least the first data element and a third data element, the first frequency being a multiple of the second frequency;

receive, from the vehicles, a plurality of diagnostic data messages at the first frequency, each including instructions that specify each data element in the respective message and unique identifiers identifying which configurations require each data element in the respective message;

compile data conforming to the diagnostic requirements per the instructions; and store the compiled data in a database for access by the requester devices.

15. The medium of claim 14, further comprising receiving the instructions as headers to the messages including the diagnostic data.

16. The medium of claim 14, wherein the diagnostic data messages received at the first frequency include at least the first and second data elements, and the diagnostic messages received at the second frequency include at least the first and third data elements.

* * * * *